US007379701B2

(12) United States Patent
Yonemoto et al.

(10) Patent No.: US 7,379,701 B2
(45) Date of Patent: May 27, 2008

(54) SHEET CASSETTE AND IMAGE FORMING APPARATUS

(75) Inventors: Satoru Yonemoto, Osaka (JP); Yukihiro Itoh, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 343 days.

(21) Appl. No.: 11/312,398

(22) Filed: Dec. 21, 2005

(65) Prior Publication Data

US 2006/0140695 A1 Jun. 29, 2006

(30) Foreign Application Priority Data

Dec. 24, 2004 (JP) ..... 2004-374322

(51) Int. Cl.
*G03G 15/00* (2006.01)

(52) U.S. Cl. ..... 399/393; 399/377; 400/601; 400/624; 400/691; 400/692; 400/693; 271/145

(58) Field of Classification Search ..... 399/377, 399/393; 400/601, 624; 271/145
See application file for complete search history.

(56) References Cited

U.S. PATENT DOCUMENTS 5,313,257 A * 5/1994 Kashima et al. ..... 399/393
6,338,585 B1 * 1/2002 Amano ..... 400/624
6,536,968 B2 * 3/2003 Lee et al. ..... 400/624
2004/0188923 A1 * 9/2004 Asada ..... 271/171

FOREIGN PATENT DOCUMENTS

JP 2004-256274 9/2004

* cited by examiner

*Primary Examiner*—Judy Nguyen
*Assistant Examiner*—Andy L Pham
(74) *Attorney, Agent, or Firm*—Smith, Gambrell & Russell, LLP

(57) ABSTRACT

A sheet cassette (1) according to the present invention has a double structure portion (10) including an upper plate (11) and a lower plate (12). The lower plate (12) has a first guide groove (13) elongated widthwise of a sheet to be contained in the cassette and having a plurality of inch-based size engagement recesses (17) and a plurality of centimeter-based size engagement recesses arranged longitudinally thereof. The upper plate (11) is movable along the lower plate (12) widthwise of the sheet to be contained in the cassette. The inch-based size engagement recesses (17) are effectuated by locating the upper plate (11) at a first position, and the centimeter-based size engagement recesses are effectuated by locating the upper plate (11) at a second position. The sheet cassette (1) further has a width limiting plate slidable widthwise of the sheet to be contained in the cassette according to the width of the sheet. A claw engageable with the effectuated inch-based size or centimeter-based size engagement recesses is attached to the width limiting plate.

6 Claims, 6 Drawing Sheets

SHEET CASSETTE AND IMAGE FORMING APPARATUS

BACKGROUND OF THE INVENTION

1. Field of the Invention

The present invention relates to a sheet cassette for use in an image forming apparatus. Particularly, the invention relates to a sheet cassette which is capable of containing inch-based size sheets as well as centimeter-based size sheets, and to an image forming apparatus including the sheet cassette.

2. Description of Related Art

In an image forming apparatus, a sheet is fed from a sheet cassette, and an image is formed on the sheet. The sheet cassette includes a width limiting plate which is slidable widthwise of sheets contained in the cassette according to the width of the sheets (as measured perpendicularly to a direction in which the sheets are fed out of the sheet cassette). By preliminarily positioning the width limiting plate in the sheet cassette according to the size of the sheets, the sheets can be aligned widthwise in a predetermined position in the sheet cassette. Thus, a sheet fed out of the sheet cassette is properly transported, and an image is formed on the sheet in the image forming apparatus.

The sheet cassette includes a rail for guiding the width limiting plate in the movement direction of the width limiting plate, and recesses are provided at positions corresponding to various sheet sizes on an edge of the rail. The width limiting plate has a claw engageable with the recesses. The width limiting plate can be fixed at a position corresponding to the size of the sheets with the claw thereof in engagement with a predetermined one of the recesses.

Meanwhile, sheets to be used in the image forming apparatus include inch-based size sheets and centimeter-based size sheets, which are often selectively contained in a single sheet cassette. In this case, recesses for the widths of the inch-based size sheets (hereinafter referred to as "inch-based size engagement recesses") and recesses for the widths of the centimeter-based size sheets (hereinafter referred to as "centimeter-based size engagement recesses") are provided on the edge of the rail. See, for example, Japanese Unexamined Patent Publication No. 2004-256274.

A user of the image forming apparatus properly positions the width limiting plate with the claw in engagement with the predetermined recess, whereby the centimeter-based size sheets or the inch-based size sheets can be set in a proper position in the sheet cassette.

In the prior art, however, the inch-based size engagement recesses and the centimeter-based size engagement recesses are provided in very close relation on the edge of the rail. For example, a so-called letter size based on inch is 216 mm×279 mm, and a Japanese Industrial Standard Column-A No. 4 size (A4 size) based on centimeter is 210 mm×297 mm. That is, a difference in short edge length between the letter size and the A4 size is 6 mm. In a sheet cassette adapted to limit the position of the sheets by sliding a pair of width limiting plates symmetrically widthwise, inch-based size engagement recesses for the letter size are spaced only 3 mm from centimeter-based size engagement recesses for the A4 size on the edge of the rail.

Hence, there is a possibility that the user of the image forming apparatus sets the claw in engagement with a wrong recess. In this case, the sheets cannot be aligned widthwise in the proper position in the sheet cassette by the width limiting plate. Therefore, a sheet fed out of the sheet cassette is offset widthwise from a predetermined position when transported through a sheet transport path in the image forming apparatus.

Accordingly, an image formed on the sheet will be offset widthwise and, in the worse case, the sheet is jammed in the sheet transport path in the image forming apparatus.

SUMMARY OF THE INVENTION

It is an object of the present invention to provide a sheet cassette in which a width limiting plate is less liable to be set at wrong positions.

It is another object of the present invention to provide a sheet cassette of a multi-use type which is capable of properly containing centimeter-based size sheets as well as inch-based size sheets.

It is further another object of the present invention to provide an image forming apparatus in which a sheet can be easily transported in a predetermined position within a transport path.

A sheet cassette according to the present invention comprises a width limiting plate for positioning a sheet to be contained in the cassette widthwise of the sheet, and a mechanism for sliding the width limiting plate widthwise of the sheet and fixing the width limiting plate at a desired position. This mechanism has a double structure portion including an upper plate and a lower plate. The lower plate has a first guide groove elongated widthwise of the sheet and having a plurality of inch-based size engagement recesses and a plurality of centimeter-based size engagement recesses. The upper plate is movable along the lower plate widthwise of the sheet, and has a second guide groove overlapping with the first guide groove as seen vertically. The inch-based size engagement recesses are effectuated by locating the upper plate at a first position, and the centimeter-based size engagement recesses are effectuated by locating the upper plate at a second position. The sheet cassette further comprises fixing means attached to the width limiting plate for fixing a position of the width limiting plate slid to be brought into engagement with one of the effectuated inch-based size or centimeter-based size engagement recesses.

DETAILED DESCRIPTION OF PREFERRED EMBODIMENTS

With reference to the attached drawings, embodiments of the present invention will hereinafter be described in detail.

Figure 1:
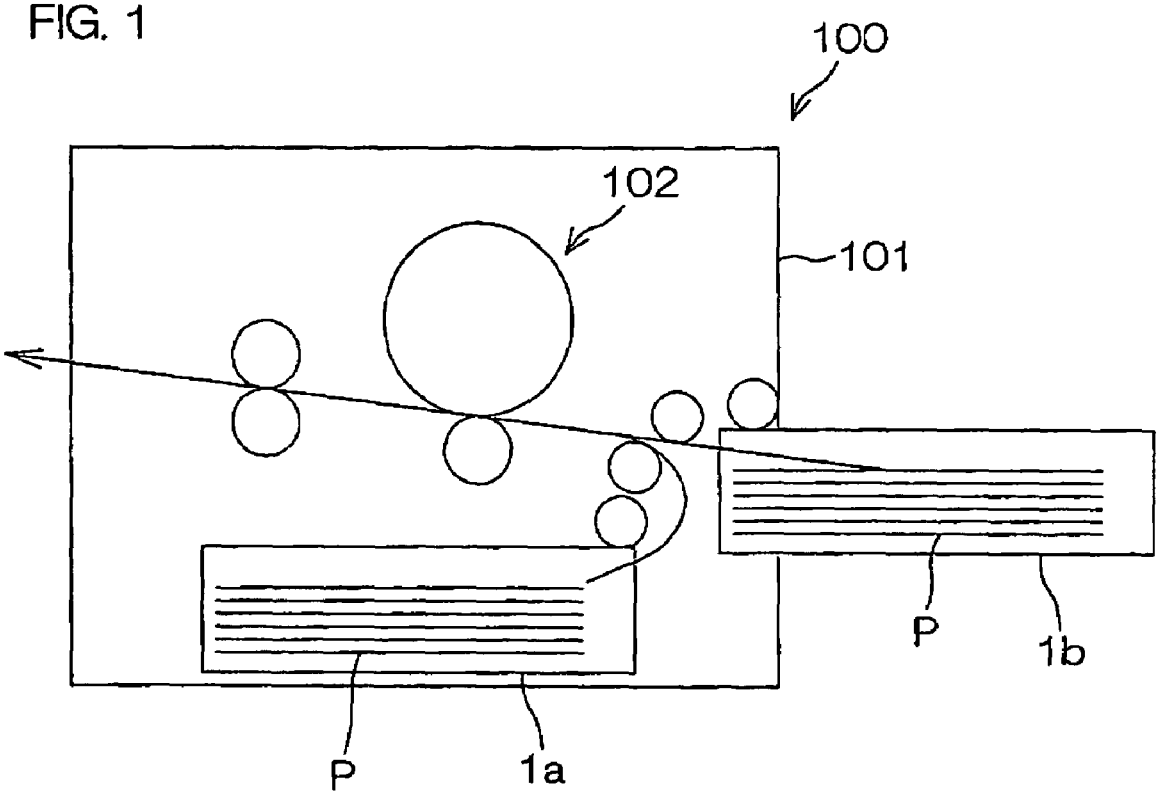
FIG. 1 is a schematic diagram of a printer according to one embodiment of the present invention.

FIG. 1 is a schematic diagram of a printer 100 as an image forming apparatus according to one embodiment of the invention. The printer 100 includes an image forming mechanism 102 provided in a housing 101 thereof for electrophotographically forming an image. Sheets P to be each printed with an image by the image forming mechanism 102 are contained in a sheet cassette 1*a* provided within the housing 101. Further, sheets P may be contained in a sheet cassette 1*b* attached to the housing 101 as projecting from a lateral side of the housing 101.

A sheet cassette 1 according to the present invention is applicable to the sheet cassette 1*a* provided within the housing 101 as well as the sheet cassette 1*b* projecting from the housing 101.

The image forming apparatus according to the present invention is not limited to the printer 100, but the invention is applicable to a copying machine, a facsimile machine and the like.

Figure 2:
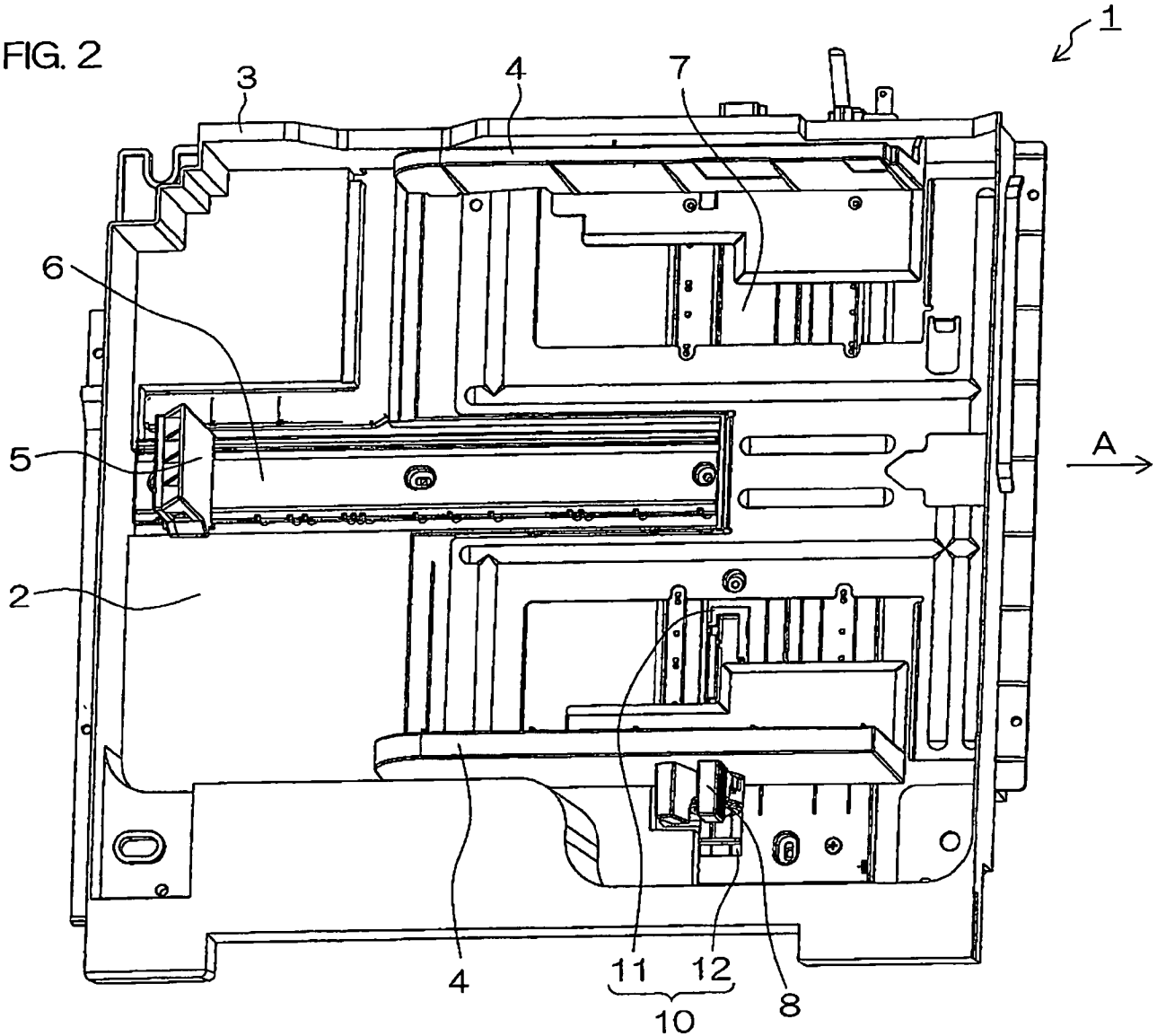
FIG. 2 is a perspective view of a sheet cassette according to another embodiment of the present invention.

FIG. 2 is a perspective view of the sheet cassette according to another embodiment of the present invention.

The sheet cassette 1 has a generally rectangular bottom plate 2 and side walls 3 projecting upright from the periphery of the bottom plate 2. The sheet cassette 1 has a box shape having a small height. Sheets contained in the sheet cassette 1 are fed out from one side of the bottom plate 2 as seen perpendicularly to the bottom plate 2 (in a sheet feed-out direction indicated by an arrow A in FIG. 2). A direction parallel to the bottom plate 2 and perpendicular to the sheet feed-out direction is herein referred to as "widthwise direction".

The sheet cassette 1 includes a guide rail 6 provided on the bottom thereof as extending in the sheet feed-out direction. The guide rail 6 is disposed in a widthwise middle portion of the sheet cassette 1. A rear edge limiting plate 5 for limiting rear edges of the sheets as seen in the feed-out direction is slidably attached to the guide rail 6.

The sheet cassette 1 further includes a guide member 7 provided on the bottom thereof as extending in the widthwise direction. The guide member 7 is disposed alongside an edge of the bottom on the sheet feed-out side. A pair of width limiting plates 4 for limiting widthwise opposite edges of the sheets are slidably attached to the guide member 7. The pair of width limiting plates 4 are maintained perpendicularly to the bottom plate 2 and generally parallel to the sheet feed-out direction, and (symmetrically) slidable so as to be spaced widthwise the same distance from a center axis of the guide rail 6.

The sheets are contained in the sheet cassette 1 with the widthwise opposite edges thereof in abutment against the corresponding width limiting plates 4 and with the rear edges thereof in abutment against the rear edge limiting plate 5. That is, the sheets are set in a predetermined position of the sheet cassette 1 which is defined with respect to the feed-out direction by the rear edge limiting plate 5 and defined with respect to the widthwise direction by the width limiting plates 4. The sheets fed out of the predetermined position of the sheet cassette 1 are individually properly transported through a transport path in the image forming apparatus (without jamming).

A fixing device 8 is attached to an outer surface of one of the width limiting plates 4 (opposite from the other width limiting plate 4).

Figure 3:
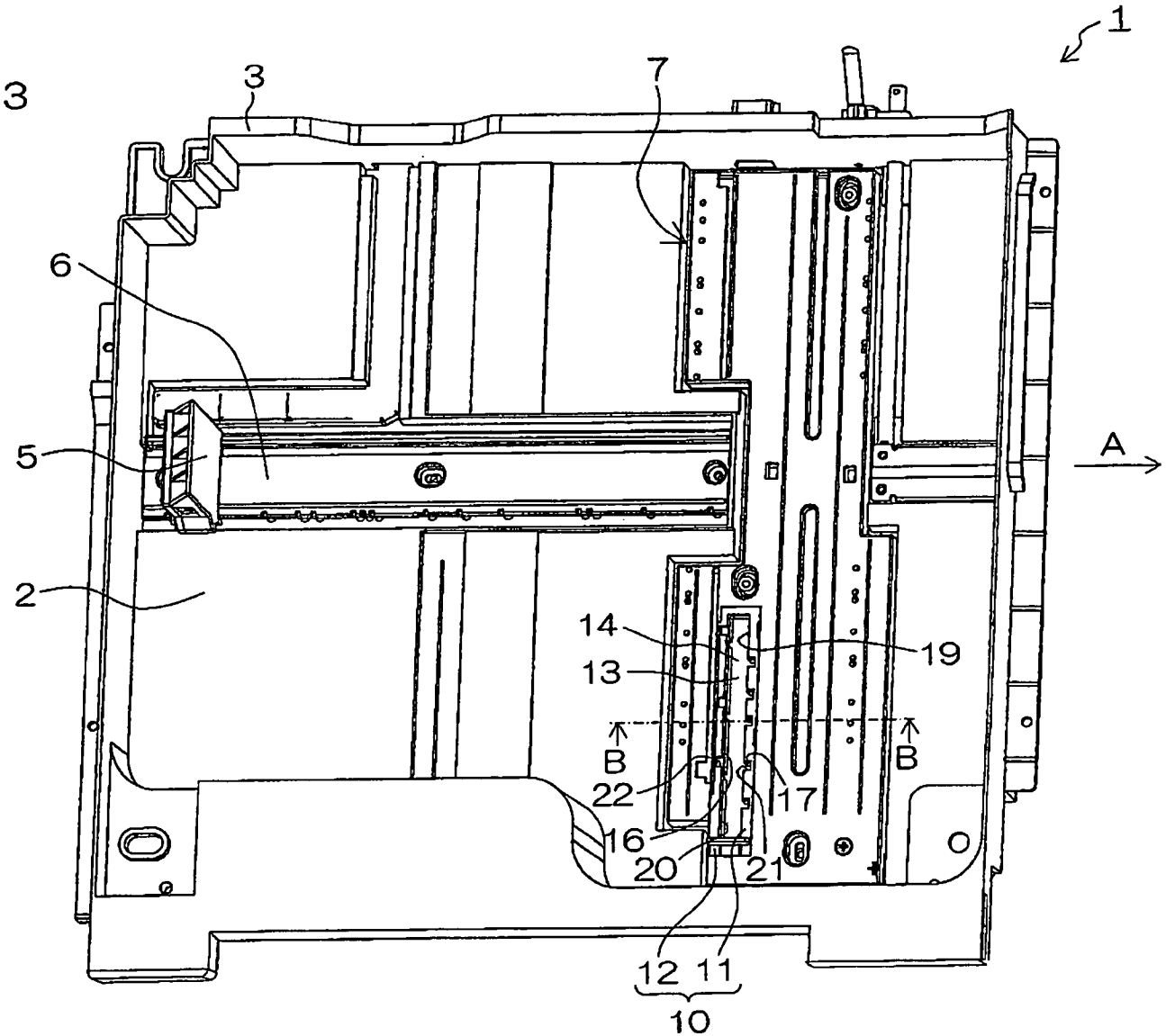
FIG. 3 is a perspective view of the sheet cassette with its upper plate located at a first position and with its width limiting plates and claws removed.
Figure 4:
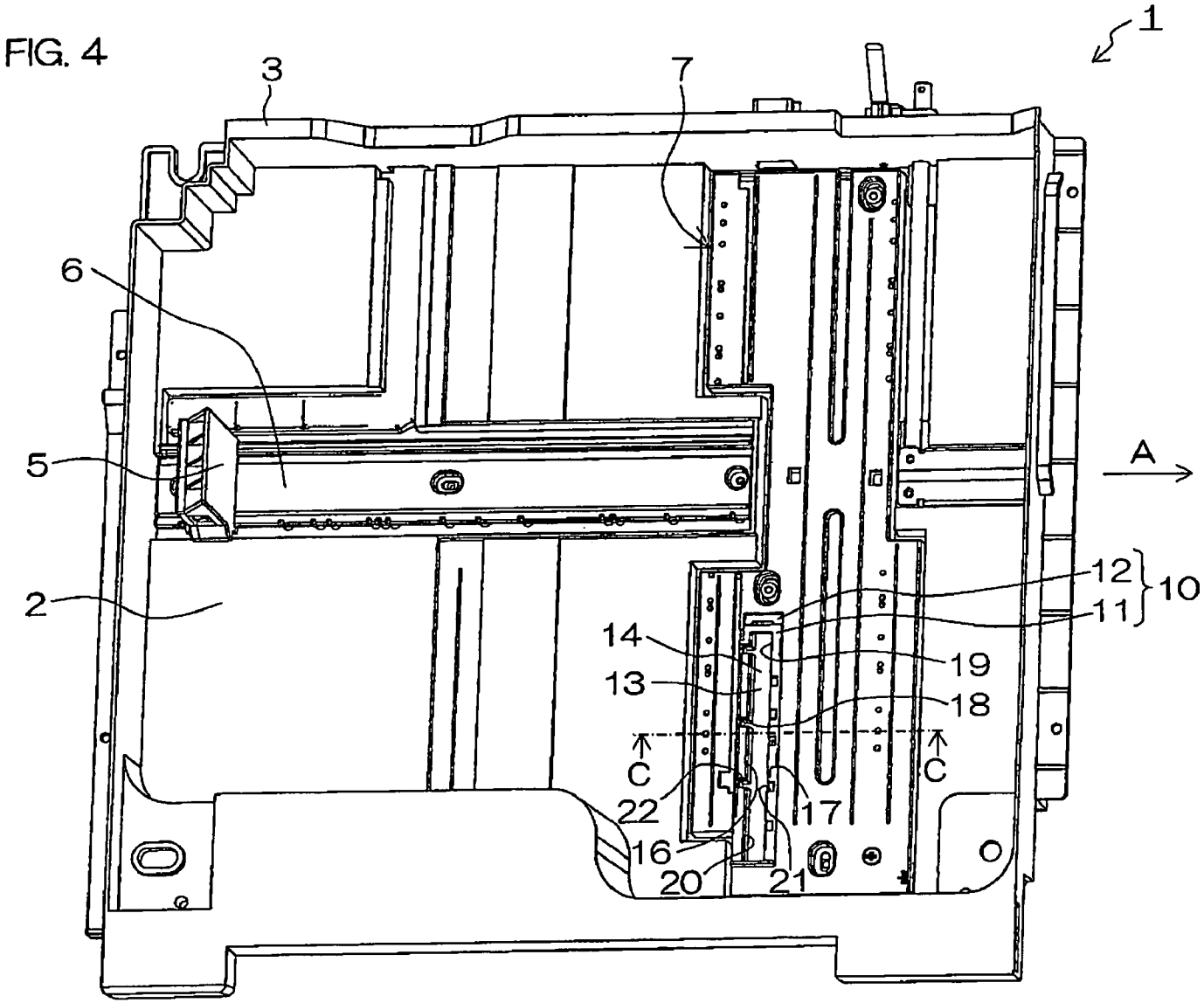
FIG. 4 is a perspective view of the sheet cassette with its upper plate located at a second position and with its width limiting plates and claws removed.
Figure 5:
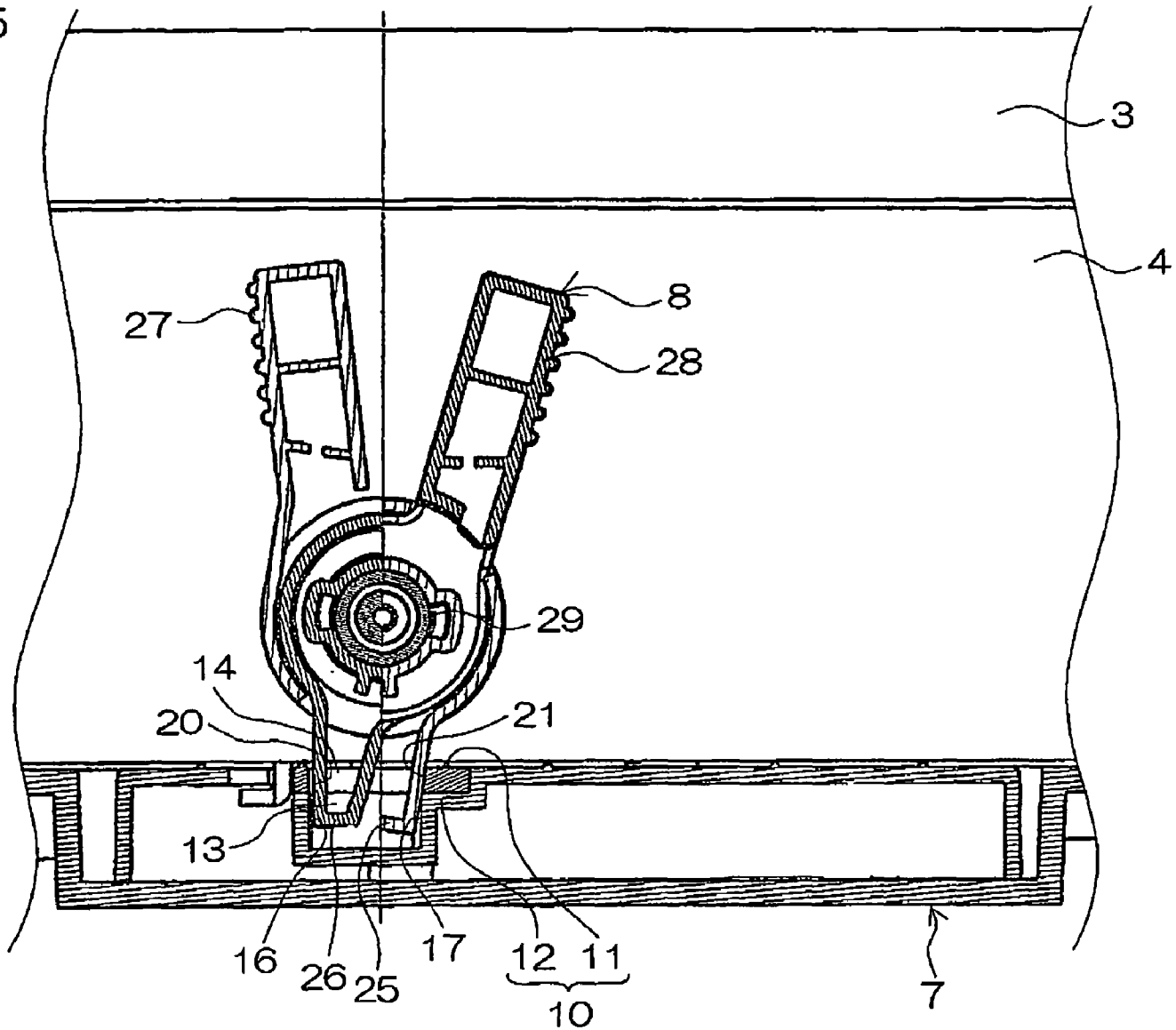
FIG. 5 is a sectional view taken along a line B-B in FIG. 3.
Figure 6:
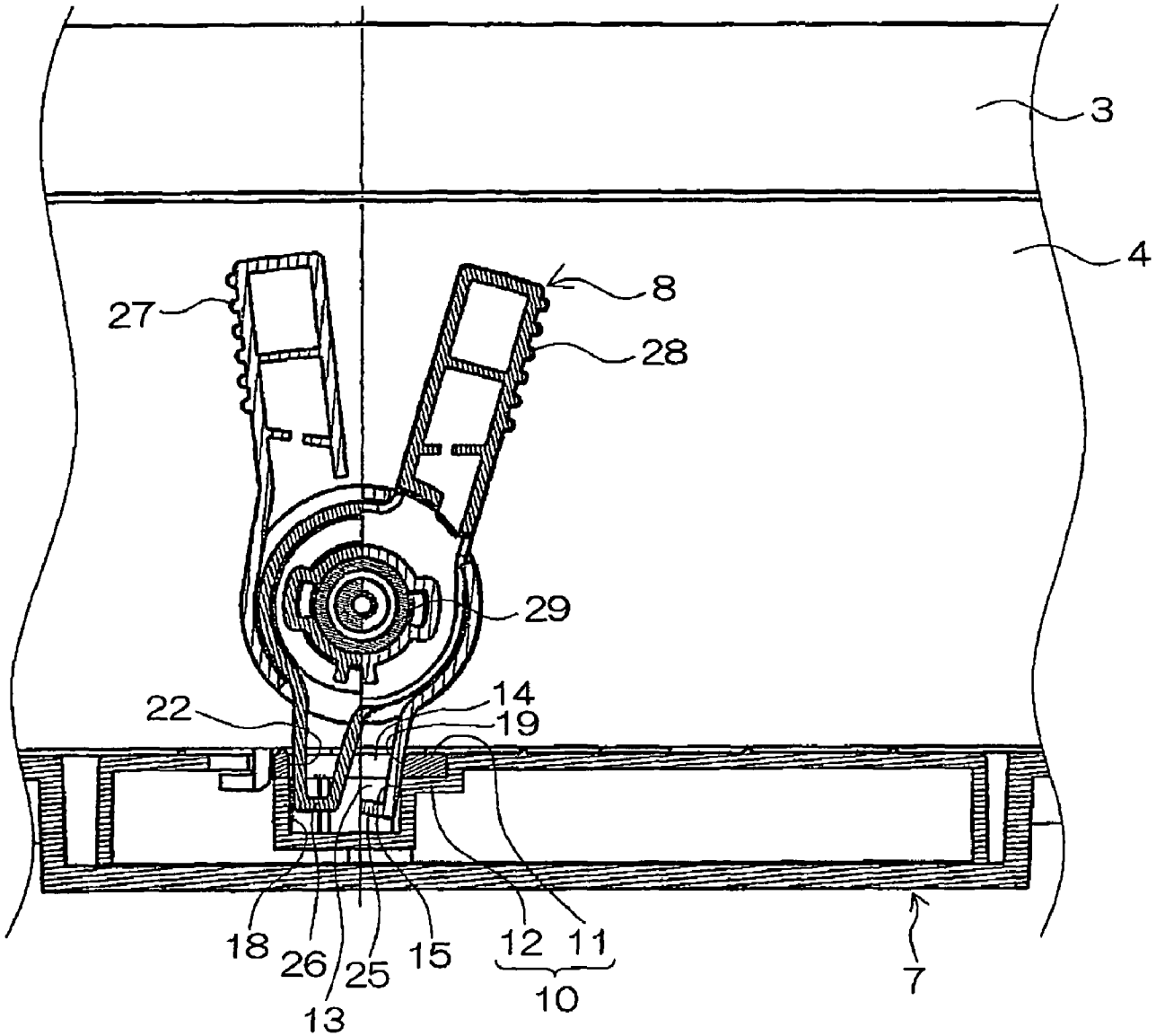
FIG. 6 is a sectional view taken along a line C-C in FIG. 4.

FIGS. 3 and 4 are perspective views of the sheet cassette 1 with its width limiting plates 4 and the fixing device 8 removed. FIG. 5 is a sectional view taken along a line B-B in FIG. 3, and FIG. 6 is a sectional view taken along a line C-C in FIG. 4.

The guide member 7 has a double structure portion 10 including an upper plate 11 and a lower plate 12. The upper plate 11 and the lower plate 12 are disposed parallel to the bottom plate 2. The upper plate 11 and the lower plate 12 each have a rectangular shape, and extend parallel to the guide member 7 and widthwise of the sheets to be contained in the sheet cassette 1. The upper plate 11 is movable longitudinally of the lower plate 12 along the lower plate 12, i.e., widthwise of the sheets to be contained in the sheet cassette 1.

The lower plate 12 has a first guide groove 13 elongated widthwise of the sheets to be contained in the sheet cassette 1, and the upper plate 11 has a second guide groove 14 overlapping with the first guide groove 13 as seen vertically (perpendicularly to the bottom plate 2).

The first guide groove 13 has a first edge 15 and a second edge 16 extending longitudinally thereof in opposed relation to define a groove width. A plurality of inch-based size engagement recesses 17 are provided on the first edge 15 and arranged longitudinally of the first guide groove 13. A plurality of centimeter-based size engagement recesses 18 are provided on the second edge 16 and arranged longitudinally of the first guide groove 13.

The second guide groove 14 has a third edge 19 and a fourth edge 20 extending longitudinally thereof in opposed relation. A plurality of inch-based size engagement recesses 21 are provided on the third edge 19, and a plurality of centimeter-based size engagement recesses 22 are provided on the fourth edge 20.

As seen vertically, the first edge 15 and the third edge 19 substantially overlap with each other, and the second edge 16 and the fourth edge 20 substantially overlap with each other.

The fixing device 8 is partly inserted in the first and second guide grooves 13, 14. More specifically, the fixing device 8 includes a first claw 25 and a second claw 26, and a pair of levers 27, 28 for operating these claws 25, 26. Distal end portions of the first claw 25 and the second claw 26 are inserted in the first and second guide grooves 13, 14. The first claw 25 and the lever 27 are formed integrally, and the second claw 26 and the lever 28 are formed integrally. The first claw 25 and the second claw 26 extend generally thicknesswise of the upper plate 11 and the lower plate 12.

The first claw 25 and the lever 27, and the second claw 26 and the lever 28 are supported pivotally about a shaft 29 at junctures between the first claw 25 and the lever 27 and between the second claw 26 and the lever 28. The first claw 25 and the second claw 26 are respectively biased toward the first edge 15 and the second edge 16 by a helical torsion spring not shown. By pinching the levers 27, 28 toward each other, the first claw 25 and the second claw 26 are respectively moved away from the first edge 15 and the second edge 16 against the resilient force of the helical torsion spring.

The upper plate 11 can be located at a first position and a second position defined with respect to the direction of the sliding of the width limiting plates.

FIGS. 3 and 5 illustrate a state in which the upper plate 11 is located at the first position. In this state, the plurality of inch-based size engagement recesses 21 on the third edge 19 of the second guide groove 14 are superposed on the plurality of inch-based size engagement recesses 17 on the first edge 15 of the first guide groove 13 as seen vertically. Thus, continuous recesses extending from the lower plate 12 to the upper plate 11 are defined by the inch-based size engagement recesses 17, 21, and the first claw 25 is engageable with any of these continuous recesses (see FIG. 5) That is, the inch-based size engagement recesses 17, 21 are effectuated.

With the first claw 25 in engagement with desired ones of the inch-based size engagement recesses 17, 21, the width limiting plates 4 are fixed at desired positions corresponding to the width of the inch-based size sheets.

At this time, the plurality of centimeter-based size engagement recesses 18 on the second edge 16 do not overlap with the plurality of centimeter-based size engagement recesses 22 on the fourth edge 20 as seen vertically, so that the centimeter-based size engagement recesses 18, 22 do not define continuous recesses extending from the lower plate 12 to the upper plate 11. In this state, edge potions of the lower plate 12 are present below the centimeter-based size engagement recesses 22 of the upper plate 11, and edge portions of the upper plate 11 are present above the centimeter-based size engagement recesses 18 of the lower plate 12 as seen vertically. This makes it impossible to bring the second claw 26 into engagement with any of the centimeter-based size engagement recesses 18, 22 on the second edge 16 and the fourth edge 20. That is, the centimeter-based size engagement recesses 18, 22 are not effectuated.

FIGS. 4 and 6 illustrate a state in which the upper plate 11 is located at the second position. In this state, the plurality of centimeter-based size engagement recesses 22 on the fourth edge 20 are superposed on the plurality of centimeter-based size engagement recesses 18 on the second edge 16 of the first guide groove 13 as seen vertically. Thus, continuous recesses extending from the lower plate 12 to the upper plate 11 are defined by the centimeter-based size engagement recesses 18, 22, and the second claw 26 is engageable with any of these continuous recesses (see FIG. 6). That is, the centimeter-based size engagement recesses 18, 22 are effectuated.

With the second claw 26 in engagement with desired ones of the centimeter-based size engagement recesses 18, 22, the width limiting plates 4 are fixed at desired positions corresponding to the width of the centimeter-based size sheets.

At this time, the plurality of inch-based size engagement recesses 17 on the first edge 15 do not overlap with the plurality of inch-based size engagement recesses 21 on the third edge 19 as seen vertically, so that the inch-based size engagement recesses 17, 21 do not define continuous recesses extending from the lower plate 12 to the upper plate 11. In this state, edge potions of the lower plate 12 are present below the inch-based size engagement recesses 21 of the upper plate 11, and edge portions of the upper plate 11 are present above the inch-based size engagement recesses 17 of the lower plate 12 as seen vertically. This makes it impossible to bring the first claw 25 into engagement with any of the inch-based size engagement recesses 17, 21 on the first edge 15 and the third edge 19. That is, the inch-based size engagement recesses 17, 21 are not effectuated.

As described above, the centimeter-based size engagement recesses 18, 22 are not effective when the inch-based size engagement recesses 17, 21 are effective, and the inch-based size engagement recesses 17, 21 are not effective when the centimeter-based size engagement recesses 18, 22 are effective. That is, the inch-based size engagement recesses 17, 21 or the centimeter-based size engagement recesses 18, 22 are effectuated, depending on whether the upper plate 11 is located at the first position or at the second position.

Therefore, when the first claw 25 should be engaged with the inch-based size engagement recesses 17, 21, the second claw 26 is prevented from being brought into engagement with the centimeter-based size engagement recesses 18, 22. Further, when the second claw 26 should be engaged with the centimeter-based size engagement recesses 18, 22, the first claw 25 is prevented from being brought into engagement with the inch-based size engagement recesses 17, 21.

As described above, means for selectively effectuating the inch-based size engagement recesses 17, 21 or the centimeter-based size engagement recesses 18, 22 is provided in the sheet cassette 1 by a simple construction.

The fixing device 8 has the first claw 25 engageable with the first edge 15 and the second claw 26 engageable with the second edge 16, thereby eliminating the need for moving a single claw between the first edge 15 and the second edge 16 for engagement with the desired ones of the inch-based size engagement recesses 17, 21 or the desired ones of the centimeter-based size engagement recesses 18, 22.

Since the first claw 25 and the second claw 26 are respectively biased toward the first edge 15 and the second edge 16, the first claw 25 or the second claw 26 can be easily kept in engagement with the desired ones of the inch-based size engagement recesses 17, 21 or the desired ones of the centimeter-based size engagement recesses 18, 22. When the first claw 25 or the second claw 26 is to be brought out of the engagement, the levers 27, 28 are pinched to move the first claw 25 and the second claw 26 away from the first edge 15 and the second edge 16 against the resilient force of the helical torsion spring, and then the fixing device 8 is slid together with the width limiting plates 4 longitudinally of the first and second guide grooves 13, 14.

Since the inch-based size engagement recesses 17, 21 provided on the first and third edges 15, 19 are separated from the centimeter-based size engagement recesses 18, 22 provided on the second and fourth edges 16, 20, which of the inch-based size engagement recesses 17, 21 and the centimeter-based size engagement recesses 18, 22 are effective can be easily visually confirmed.

The embodiments described above are examples of the present invention, and it should be understood that the invention be not limited to the embodiments. For example, the double structure portion 10 may be constructed such that both the inch-based size engagement recesses and the centimeter-based size engagement recesses are effectuated by locating the upper plate 11 at a third position. In this case, a set of inch-based size engagement recesses different from the aforesaid inch-based size engagement recesses 17, 21 are provided on the first and third edges 15, 19, and a set of centimeter-based size engagement recesses different from the aforesaid centimeter-based size engagement recesses 18, 22 are provided on the second and fourth edges 16, 20.

In this case, when the upper plate 11 is located at the third position, the fixing device 8 (the first claw 25 or the second claw 26) can be brought into engagement with desired ones of the inch-based size engagement recesses and the centimeter-based size engagement recesses. That is, the fixing device 8 can be easily moved between any of the inch-based size engagement recesses and any of the centimeter-based size engagement recesses without switching the upper plate 11 between the first position and the second position.

For example, where sheets to be temporarily used in the single sheet cassette 1 are frequently changed between the inch-based size sheets and the centimeter-based size sheets, easier handling is desired on condition that a user does not set the fixing device 8 at a wrong recess. In such a case, the upper plate 11 may be located at the third position.

It is noted that various modifications may be made within the scope of the present invention defined by the following claims.

This Application corresponds to Japanese Patent Application No. 2004-374322 filed with the Japanese Patent Office on Dec. 24, 2004, the disclosure of which is incorporated herein by reference.

What is claimed is:

1. A sheet cassette for containing a sheet to be fed into an image forming device, comprising:

a double structure portion including an upper plate and a lower plate;

the lower plate having a first guide groove elongated widthwise of the sheet to be contained in the cassette and having a plurality of inch-based size engagement recesses and a plurality of centimeter-based size engagement recesses arranged longitudinally thereof;

the upper plate being movable along the lower plate widthwise of the sheet to be contained in the cassette, and having a second guide groove overlapping with the first guide groove as seen vertically;

the inch-based size engagement recesses being effectuated by locating the upper plate at a first position;

the centimeter-based size engagement recesses being effectuated by locating the upper plate at a second position;

a width limiting plate slidable widthwise of the sheet to be contained in the cassette according to a width of the sheet; and fixing means attached to the width limiting plate and partly inserted in the first guide groove and the second guide groove for fixing a position of the width limiting plate slid to be brought into engagement with one of the effectuated inch-based size or centimeter-based size engagement recesses.

2. A sheet cassette as set forth in claim 1, wherein the first guide groove has a first edge and a second edge extending longitudinally thereof in opposed relation to define a groove width, the plurality of inch-based size engagement recesses are provided on the first edge, and the plurality of centimeter-based size engagement recesses are provided on the second edge.

3. A sheet cassette as set forth in claim 2, wherein the second guide groove has a third edge and a fourth edge extending longitudinally thereof in opposed relation, a plurality of inch-based size engagement recesses are provided on the third edge, a plurality of centimeter-based size engagement recesses are provided on the fourth edge, the plurality of inch-based size engagement recesses on the third edge are superposed on the plurality of inch-based size engagement recesses on the first edge of the first guide groove for effectuation of the inch-based size engagement recesses by locating the upper plate at the first position, and the plurality of centimeter-based size engagement recesses on the fourth edge are superposed on the plurality of centimeter-based size engagement recesses on the second edge of the first guide groove for effectuation of the centimeter-based size engagement recesses by locating the upper plate at the second position.

4. A sheet cassette as set forth in claim 3, wherein the fixing means includes:

a first claw engageable with the first edge;

a second claw engageable with the second edge; and a lever for operating these two claws.

5. A sheet cassette as set forth in claim 1, wherein the inch-based size engagement recesses and the centimeter-based size engagement recesses are effectuated by locating the upper plate at a third position.

6. An image forming apparatus comprising a sheet cassette as recited in claim 1.

* * * * *